US006398580B2

(12) United States Patent
Lin et al.

(10) Patent No.: US 6,398,580 B2
(45) **Date of Patent: *Jun. 4, 2002**

(54) ELECTRICAL TERMINAL MEMBER

(75) Inventors: Jeff C. Lin, Novi; Paul Jerome Brzyski, Rochester, both of MI (US)

(73) Assignee: Visteon Global Tech., Inc., Dearborn, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/481,821

(22) Filed: Jan. 11, 2000

(51) Int. Cl.[7] ..... H01R 4/24
(52) U.S. Cl. ..... 439/402
(58) Field of Search ..... 439/49, 402, 403, 439/404, 621, 949, 393, 395, 396, 397, 398

(56) References Cited

U.S. PATENT DOCUMENTS

| | | | | | |
|---|---|---|---|---|---|
| 4,127,312 | A | * | 11/1978 | Fleischhacker et al. | 339/99 |
| 4,533,196 | A | | 8/1985 | Peter et al. | |
| 4,586,775 | A | | 5/1986 | Nestor et al. | |
| 4,615,576 | A | | 10/1986 | Gerke et al. | |
| 5,026,305 | A | * | 6/1991 | Del Guiddice et al. | 439/620 |
| 5,194,014 | A | * | 3/1993 | McClune et al. | 439/404 |
| 5,399,098 | A | * | 3/1995 | Marshall et al. | 439/398 |
| 5,547,391 | A | | 8/1996 | Benes et al. | |
| 5,554,040 | A | | 9/1996 | Sugiura et al. | |
| 5,567,173 | A | * | 10/1996 | Franckx | 439/418 |
| 5,622,516 | A | | 4/1997 | Baggett et al. | |
| 5,626,492 | A | * | 5/1997 | Onizuka et al. | 439/512 |
| 5,651,691 | A | * | 7/1997 | Grumel | 439/417 |
| 5,667,414 | A | * | 9/1997 | Karacora | 439/849 |
| 5,762,516 | A | | 6/1998 | Itoga et al. | |
| 5,800,215 | A | | 9/1998 | Ingo et al. | |
| 5,888,090 | A | * | 3/1999 | Achee | 439/417 |
| 5,902,147 | A | | 5/1999 | Jochen et al. | |
| 5,954,533 | A | * | 9/1999 | Hatagishi et al. | 439/397 |
| 5,975,936 | A | * | 11/1999 | Lin et al. | 439/404 |
| 6,027,362 | A | * | 2/2000 | LaCroix | 439/404 |
| 6,086,405 | A | * | 7/2000 | Liebich | 439/397 |
| 6,093,047 | A | * | 7/2000 | Ann | 439/398 |
| 6,142,817 | A | * | 11/2000 | Lee | 439/395 |
| 6,280,253 | B1 | * | 8/2001 | Kraus et al. | 439/621 |

FOREIGN PATENT DOCUMENTS

| | | | | |
|---|---|---|---|---|
| DE | 17 51 678 U | | 7/1957 | |
| DE | 44 23 339 C | | 9/1995 | |
| GB | 2125638 | * | 3/1984 | 439/398 |

* cited by examiner

*Primary Examiner*—Tulsidas Patel
*Assistant Examiner*—Thanh-Tam Le
(74) *Attorney, Agent, or Firm*—Visteon Global Tech., Inc.

(57) ABSTRACT

A terminal member 10 having a body 12 and outwardly protruding blades 14. The body 12 and blades 14 include respective insulation displacement apertures 48, 20 which selectively allow high powered electrical signals to be received by the terminal member 10 and which further allow the selective creation of many diverse types of electrical circuits.

15 Claims, 2 Drawing Sheets

ELECTRICAL TERMINAL MEMBER

FIELD OF THE INVENTION

This invention relates to an electrical terminal member and more particularly to an electrical terminal member which allows for the selective creation of electrical circuits employing a wide variety of conductors and electrical signals.

BACKGROUND OF THE INVENTION

Electrical terminal members allow for the selective formation of electrical circuits by physically receiving a plurality of electrical conductors and by physically and communicatively coupling some or all of the received electrical conductors in a certain and desired manner. Typically each of these conductors are contained within an insulative cover or sheath. These terminal members typically include a single row or "level" of insulation displacement portions which each selectively receive such a conductor, which remove a portion of the sheath of the received conductor, and which concomitantly contact the respectively exposed conductor, thereby creating an electrical connection. Hence, these electrical terminal members respectively provide several paths through which electrical current or signals may flow or be communicated by and between the attached conductors, thereby creating electrical circuits.

These terminal members or "terminal strips" are becoming increasingly prevalent in many assemblies and apparatuses, such as in vehicles, due to the proliferation in the use of many diverse types of electronic components within vehicles and within a wide variety of other types of apparatuses and assemblies. The widespread use of this relatively wide variety of electrical components has increased the use of many diverse types of electrical signals and has increased the need to adequately distribute electrical power within an assembly or apparatus in order to ensure that the contained electrical components continue to properly operate.

While these prior terminal members or "terminal strips" do allow for the selective creation of multiple types of circuits by integrally forming and/or providing one row or "level" of insulation displacement portions, they suffer from some drawbacks. That is, many of these prior terminal members do not adequately allow for the concomitant and relatively efficient creation of electrical circuits having respectively diverse types of electrical current or signals and, more particularly, do not adequately allow for the reception and distribution of electrical power to all of the various contained components. These prior terminal members also do not readily allow for the addition and/or creation of circuits, especially electrical power type circuits, by and between existing terminal assemblies and/or between terminals which have been previously installed upon a circuit board and/or assembly.

There is therefore a need for an electrical terminal member which allows for the creation of diverse types of electrical circuits, which allows for the relatively efficient reception and distribution of electrical power to electrical components, and which allows electrical circuits, such as electrical power circuits, to be easily formed and/or constructed by use of terminal members which have been previously installed within an assembly and/or circuit board.

SUMMARY OF THE INVENTION

It is a first object of the present invention to provide an electrical terminal member which overcomes some or all of the previously delineated drawbacks associated with prior electrical terminal members.

It is a second object of the present invention to provide an electrical terminal member which overcomes some or all of the previously delineated drawbacks associated with prior electrical terminal members and which, by way of example and without limitation, allows for the efficient distribution of electrical power to various components.

It is a third object of the present invention to provide an electrical terminal member which overcomes some or all of the previously delineate drawbacks associated with prior electrical terminal members and which allows for the selective creation of diverse types of electrical circuits.

It is a fourth object of the present invention to provide an electrical terminal member having multiple levels of insulation displacement portions, effective to allow an electrical circuit to be formed by use of the electrical terminal member even when the electrical terminal member has been inserted within a circuit board or other electrical assembly and/or even when portions of the electrical terminal member are inaccessible.

According to a first aspect of the present invention, a terminal member is provided. The terminal member comprises a relatively wide terminal body which integrally forms a blade portion having a slotted insulation displacement aperture which has a longitudinal axis of symmetry which is perpendicular to the terminal body.

According to a second aspect of the present invention, a terminal member having multiple insulation displacement levels is provided.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

Figure 1:
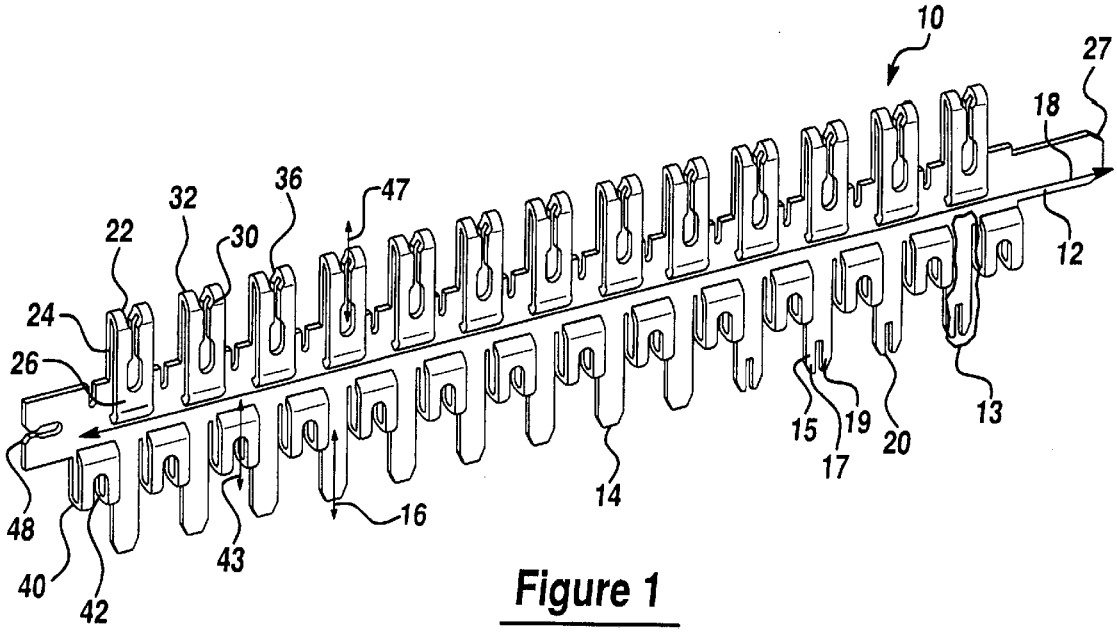
FIG. 1 is a perspective view of a terminal member which is made in accordance with the teachings of the preferred embodiment of the invention.
Figure 2:
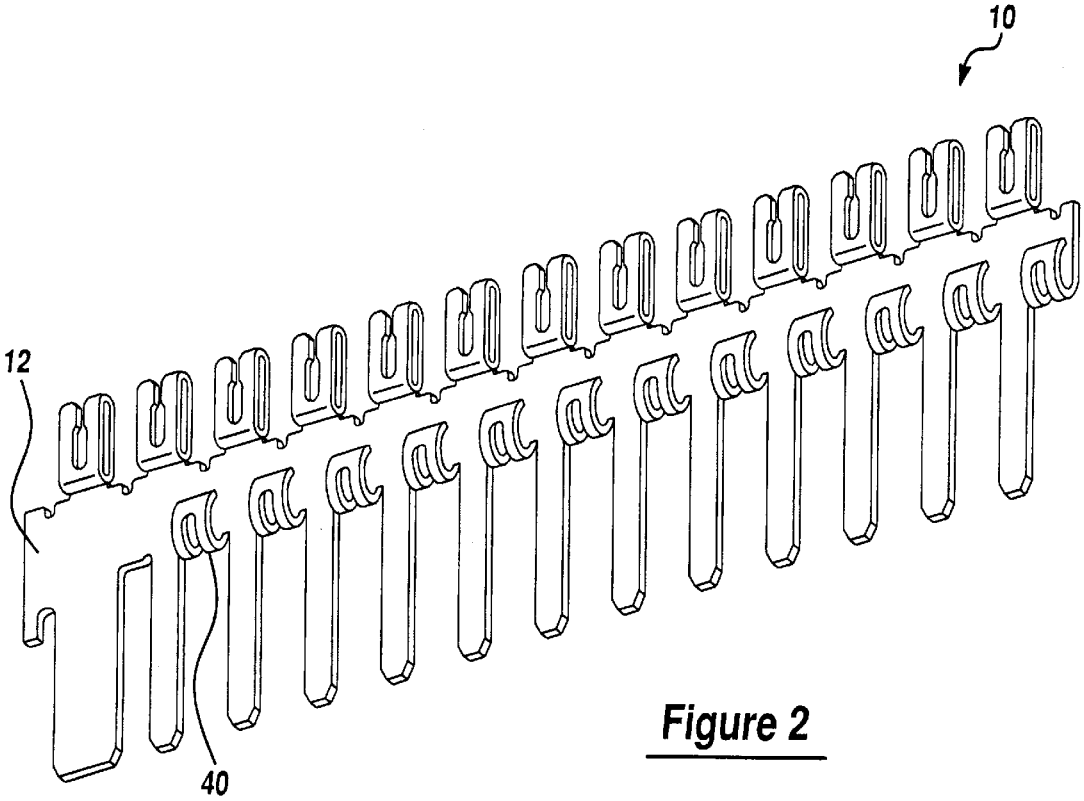
FIG. 2 is a perspective view of a terminal member which is made in accordance with the teachings of an alternate embodiment of the invention.

Referring now to FIGS. 1 and 2, there is shown a terminal member 10 which is made in accordance with the teachings of the preferred embodiment of the invention. Particularly, terminal member 10 includes a generally planar and relatively wide body portion 12 which forms and/or integrally includes several substantially evenly spaced and outwardly protruding protrusions or blades 14 which have a respective longitudinal axis of symmetry 16 which is substantially orthogonal to the longitudinal axis of symmetry 18 of the body portion 12. Each of the protrusions or blades 14 are each substantially coplanar to the body portion 12. Particularly, the body portion 12 and the protruding blades 14 reside within substantially the same plane 13. In another non-limiting embodiment, blades 14 may be unevenly spaced upon and/or formed by body portion 12.

In the preferred embodiment of the invention, at least some of the blades 14 include an insulation displacement portion or slotted aperture 20 which is formed upon respective blade insertion portions or edges 15 and which allows relatively large gauge and relatively high power conductors to be properly and operatively terminated upon the terminal 10 by "stripping" or respectively removing portions of the insulative cover or "sheath" containing the respectively received conductors, thereby allowing the respectively exposed conductors to physically and electrically contact the portions 17, 19 of each respective conductor containing aperture 20. Particularly, since the blades 14 are integrally formed with the body portion 12, the relatively high-powered signals may be distributed along the body 12 without substantially damaging the terminal 10.

Further, terminal 10 includes several substantially identical component reception portions 22 which have a first portion 24 which is substantially coplanar to the body portion 12, which wholly resides within plane 13, and which outwardly protrudes from the body portion 12, in a direction opposite to the direction that blades 14 protrude, and a second portion 26 which is integrally formed with portion 24 and which resides in a plane which is substantially parallel to the plane which wholly contains the body portion 12. Further, portions 24 and 26 form a pair of substantially identical shoulders 30, 32 which cooperatively form a component reception slot 36 which is adapted to selectively receive a portion of an electrical component, effective to allow the received electrical component to be placed within one or more selectively formed circuits. Each component reception portion 22 has a longitudinal axis of symmetry 47 which is substantially parallel to the longitudinal axis of symmetry 16 and orthogonal to the longitudinal axis of symmetry 18, and each portion 22 is "aligned" with a unique one of the blades 14 (i.e., residing above a unique one of the blades 14).

Terminal 10 further includes several substantially identical and substantially and equally spaced or distributed connectors or component reception portions 40 which cooperate with body portion 12 to form a slotted aperture 42 which is adapted to selectively receive a component. Apertures 42 each have a longitudinal axis of symmetry 43 which is substantially parallel to the longitudinal axis of symmetry 47 of each of the apertures 36. Terminal 10 also includes at least one slotted insulation displacement aperture 48 which resides upon the body 12 along the longitudinal axis of symmetry 18 and which further is adapted to receive a component and/or conductor and allows relatively high electrical power signals to be coupled and/or communicated to the body portion 12. In this manner, terminal member 10 includes a first "level" of insulation displacement apertures which reside upon edges 15 and a second "level," of insulation displacement apertures, such as aperture 48, which may be used to selectively receive a relatively high powered conductor (or other type of signal containing conductor), thereby allowing such electrical circuits to be formed even when the insulation displacement portions 15 are hidden or substantially inaccessible due to, by way of example and without limitation, their respective placement within a circuit board assembly or other type of device or assembly. Further, body portion 12 includes a blade 27 which extends along the longitudinal axis of symmetry 18 and which further allows the member 10 to be contained within a reception cavity (not shown) in a direction along axis 18, thereby increasing the overall utility of the terminal member 10.

In a second embodiment of the invention, as best shown in FIG. 2, portions 40 are substantially curved in order to facilitate the efficient placement of certain electrical components within the slotted apertures 42.

Figure 3:
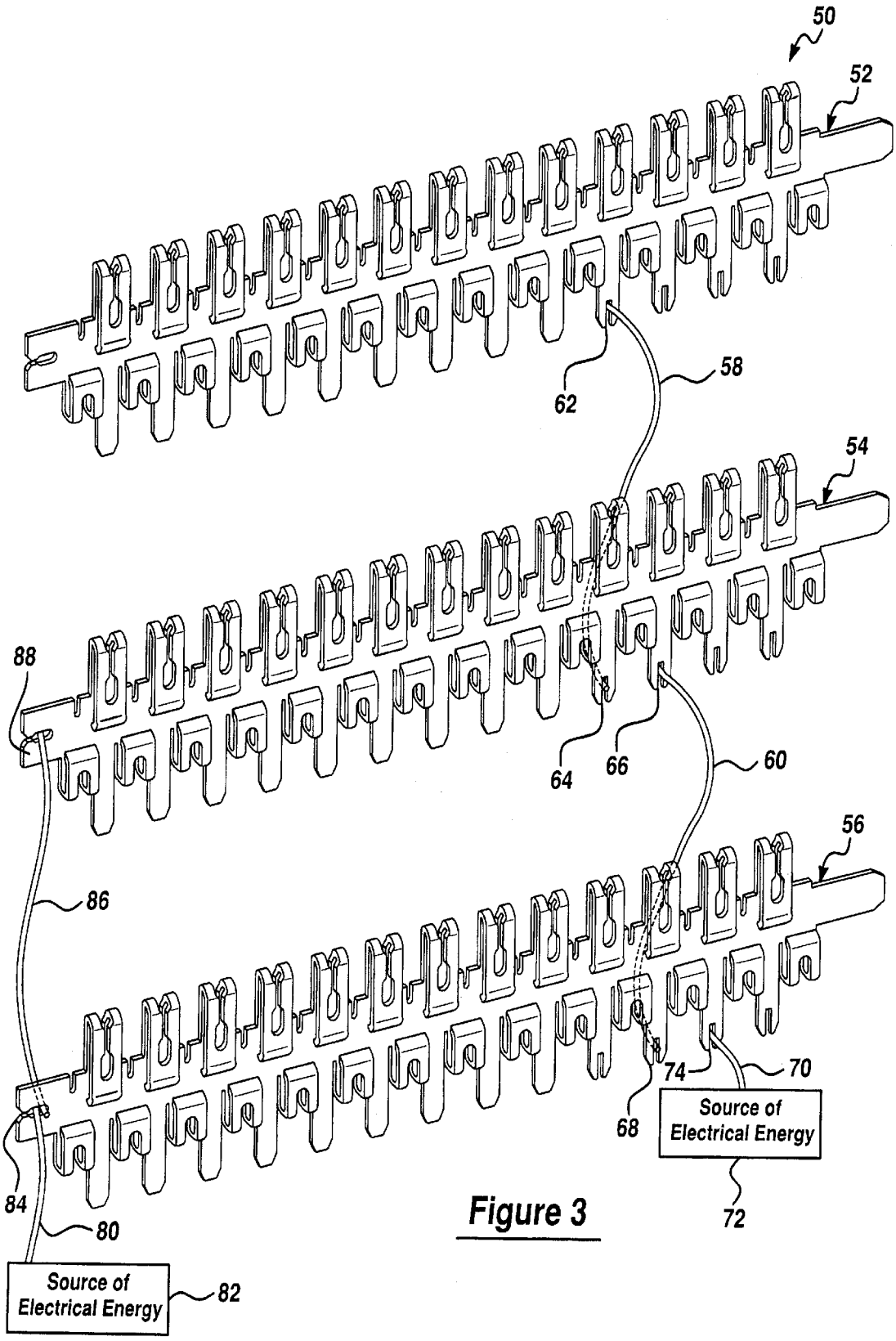
FIG. 3 is a perspective view of a terminal assembly which is dynamically configured in accordance with the teachings of the preferred embodiment of the invention.

Referring now to FIG. 3, there is shown a terminal assembly 50 which is made in accordance with the preferred embodiment of the invention. As shown, assembly 50 includes separate but substantially identical terminal members 52, 54, and 56 which are respectively and substantially identical to terminal member 10 and which are selectively interconnected by use of relatively high powered bus or conductors 58, 60.

As shown, conductor 58 is connected and/or received within insulation displacement aperture 62 of member 52 and within the insulation displacement aperture 64 of member 54. Conductor 60 is connected and/or received within insulation displacement aperture 66 of member 54 and within the insulation displacement aperture 68 of member 56. Conductor 70 is coupled to a first source of electrical energy 72 and to insulation displacement aperture 74 of terminal member 56. Conductor 80 is coupled to a second source of electrical power 82 and to insulation displacement aperture 84 of terminal member 56. Conductor 86 is coupled to insulation displacement aperture 84 of terminal member 56 and to insulation displacement aperture 88 of terminal member 54.

In this manner, it should be appreciated that electrical power may be selectively provided to terminal members such as terminal members 54, 56, by one or more sources of electrical power, such as electrical sources 82, 72, and that this relatively high-powered signal may be coupled to contained components by use of the various apertures, such as aperture or reception slot 22, which is formed within these terminal members. That is, in this non-limiting example, conductors 58 and 60 cooperate with terminal members 54, 56 to communicate electrical energy/power from the source 72 to the portion 62 of the terminal member 52. Conductor 60 provides such electrical power/energy to the terminal portion 66 of terminal member 54. Conductor 86 communicates electrical power/energy from terminal 56 to the insulation displacement aperture 88 of the terminals 54.

It should be understood that the invention is not limited to the exact embodiment or method which has been previously delineated above, but that various changes and modifications may be made without departing from the spirit and the scope of the following claims.

What is claimed is:

1. A terminal member having a generally planar body portion including a first insulation displacement aperture, at least one integrally formed blade which protrudes from said body portion and which includes a second insulation displacement aperture, and a folded component reception member which includes a first portion which is substantially coplanar to said body portion and which outwardly protrudes from said body portion in a direction opposite to the direction that said at least one integrally formed blade protrudes, said component reception member further having a second portion which resides in a plane which is different from and substantially parallel to the plane in which said body portion resides.

2. The terminal member of claim 1 wherein said body portion has a first longitudinal axis and wherein said at least one protruding blade has a second longitudinal axis which is orthogonal to said first longitudinal axis.

3. The terminal member of claim 2 wherein said first insulation displacement aperture resides along said first longitudinal axis.

4. The terminal member of claim 3 wherein said component reception member has a third longitudinal axis which is orthogonal to said first longitudinal axis and which is substantially parallel to said second longitudinal axis.

5. The terminal member of claim 4 wherein said component reception member is generally arcuate.

6. A terminal member comprising an electrically conductive body having a plurality of blades which outwardly extend from said body in a first direction, each of said blades respectively including an insulation displacement portion, said body further including a plurality of folded component reception members which are each aligned with a unique one of said plurality of blades, each of said component reception members including a first portion which is substantially coplanar to said body portion and which outwardly protrude from said body portion in a second direction opposite to said first direction and a second portion which resides in a plane which is different from and substantially parallel to the plane in which said body portion resides, and said body further having a longitudinal axis along which at least one insulation displacement aperture is positioned.

7. The terminal member of claim 6 wherein said body further forms generally accurate second component reception members.

8. The terminal member of claim 6 wherein said body further includes an integrally formed blade portion which extends along said longitudinal axis.

9. A method for making a terminal assembly, said method comprising the steps of:

providing a member having generally planar body portion and at least one integrally formed blade which protrudes from said body;

forming a first insulation displacement aperture within said at least one blade;

forming at least one folded component reception member upon said body portion, said at least one folded component reception member including a first portion which is substantially coplanar to said body portion and which outwardly protrudes from said body portion in a direction opposite to the direction in which said at least one integrally formed blade protrudes and a second portion which resides in a plane which is substantially parallel to and which is different from the plane in which said body portion resides; and forming a second insulation displacement aperture within said body.

10. The method of claim 9 wherein said body has a longitudinal axis and wherein said second insulation displacement aperture is formed along said longitudinal axis.

11. The method of claim 10 wherein said at least one blade has an insertion edge and wherein said first insulation displacement aperture is formed within said insertion edge.

12. The method of claim 11 further comprising the step of selectively connecting said terminal assembly to a source of electrical energy.

13. The method of claim 10 further comprising the step of forming at least one second and arcuate component reception member upon said body.

14. The method of claim 13 wherein said at least one blade protrudes from said body in a first direction and wherein said at least one second component reception member extends from said body in a second direction.

15. The method of claim 14 wherein said second direction is substantially parallel to said first direction.

* * * * *